US009265328B2

(12) United States Patent
Braeuer et al.

(10) Patent No.: US 9,265,328 B2
(45) Date of Patent: Feb. 23, 2016

(54) APPLICATOR DEVICE

(75) Inventors: Lutz Braeuer, Igensdorf (DE); Britta Lorenz, Nuremberg (DE); Clemens Wiesmann, Heroldsberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 13/643,512

(22) PCT Filed: Feb. 21, 2012

(86) PCT No.: PCT/EP2012/000754

§ 371 (c)(1),
(2), (4) Date: Oct. 25, 2012

(87) PCT Pub. No.: WO2012/113539

PCT Pub. Date: Aug. 30, 2012

(65) Prior Publication Data

US 2013/0322949 A1 Dec. 5, 2013

(30) Foreign Application Priority Data

Feb. 23, 2011 (DE) ..... 20 2011 003 088 U

(51) Int. Cl.
*A45D 40/20* (2006.01)
*A45D 40/04* (2006.01)
*A45D 40/24* (2006.01)

(52) U.S. Cl.
CPC ..... *A45D 40/20* (2013.01); *A45D 40/04* (2013.01); *A45D 40/205* (2013.01); *A45D 40/24* (2013.01); *A45D 2040/208* (2013.01)

(58) Field of Classification Search
CPC ..... A45D 40/04; A45D 40/06; A45D 40/205; B43K 21/08; B65D 83/0011
USPC ..... 401/6, 48, 68; D28/7, 85
See application file for complete search history.

(56) References Cited

U.S. PATENT DOCUMENTS

| | | | | |
|---|---|---|---|---|
| 5,018,892 | A | 5/1991 | Krueckel et al. | |
| 5,364,197 | A | 11/1994 | Powers | |
| 5,366,311 | A | 11/1994 | Powers | |
| 5,895,161 | A | 4/1999 | Winkler et al. | |
| 6,224,281 | B1 * | 5/2001 | Kim | 401/68 |
| 7,052,198 | B2 | 5/2006 | Sasaki | |
| 7,789,581 | B2 | 9/2010 | Heidenreiter | |
| 2003/0138281 | A1 | 7/2003 | An | |
| 2005/0180805 | A1 * | 8/2005 | Sasaki | 401/68 |
| 2011/0194884 | A1 * | 8/2011 | Kim | 401/68 |

FOREIGN PATENT DOCUMENTS

| | | |
|---|---|---|
| DE | 3215215 A1 | 10/1983 |
| DE | 3728427 C1 | 12/1988 |

(Continued)

*Primary Examiner* — David Walczak
*Assistant Examiner* — Bradley Oliver
(74) *Attorney, Agent, or Firm* — Bachman & LaPointe, P.C.

(57) ABSTRACT

An applicator device for applying a mass in the form of a stick (1) extending longitudinally along a longitudinal axis (M), comprising a rotatable part (10) through which the stick (1) is guided and which has an exit opening (12) for the stick (1), a hollow shaft (41) coupled to the rotatable part (10) via an axially fixed rotatable connection for axially advancing the stick (1), a body (20) fixedly connected to the hollow shaft (41), and a cap (30) for the rotatable part (10), which is detachably connected to the hollow shaft (41), the axially fixed rotatable connection being formed by a coupling portion of the rotatable part (K.2) and a complementary counterpart coupling portion (K.1) of the hollow shaft (41) in a coupling portion (K) in which the hollow shaft (41) and the rotatable part (10) engage with each other.

13 Claims, 3 Drawing Sheets

(56) References Cited

FOREIGN PATENT DOCUMENTS

| | | | |
|---|---|---|---|
| DE | 3835679 | A1 | 4/1990 |
| DE | 4445230 | C2 | 6/1996 |
| DE | 19851219 | A1 | 5/2000 |
| DE | 102005028932 | B4 | 3/2010 |
| GB | 2119320 | A | 11/1983 |
| JP | 2001150858 | A | 6/2001 |
| JP | 2003047525 | A | 2/2003 |
| JP | 2005230119 | A | 9/2005 |

* cited by examiner

X-X

APPLICATOR DEVICE

BACKGROUND OF THE INVENTION

The present invention relates to an applicator device for applying a mass in the form of a stick, in particular a cosmetic mass.

Applicator devices for cosmetic preparations, in the form of pencils, preferably with a rotating mechanism with which the stick mass is introduced into a front portion of the rotation mechanism and can be twisted axially out of same, or is disposed such that it can be twisted forwards and backwards, are well-known. Mention can be made in this regard of DE 32 15 215 A1, DE 198 51 219 A1, DE 37 28 427 C1, DE 38 35 679 C2 and DE 44 45 230 C2, for example, or U.S. Pat. No. 5,366,311 A and U.S. Pat. No. 5,364,197 A.

These applicator devices are used as "liners", e.g. as lip liners, eye liners, eyebrow pencils or as cover-up sticks applied to certain points. Such "liners" usually have stick diameters ranging from 2 to 5 mm, with a useful length of the stick ranging from 35 to 60 mm. This means that applicator devices of the aforementioned kind have substantially different dimensions (and thus substantially different handling problems as well) from conventional lipsticks with stick diameters ranging between 10 and 15 mm and with stick lengths of between 35 and 45 mm.

A generic applicator device generally has the shape of an elongate cylinder. A front portion of the applicator device must be sufficiently long to accommodate the stick mass to be applied, and in the rear portion of the applicator device there is usually a threaded spindle which is non-rotatingly yet axially displaceably mounted, and which cooperates with a threaded portion in the front portion and which can push the stick mass out of the applicator device.

In applicator devices in the field of cosmetics, the stick mass consists of a more or less soft cosmetic material which is to be lightly applied to human skin and the like. In most cases, such cosmetic masses are not rigid bodies, but thixotropic preparations that are deformed or even liquefied when exposed to compressive or shearing forces. An intermediate member is therefore needed between the threaded spindle and the stick mass, in order to convert the relative rotational movement of the pusher spindle into an exclusively axial movement for the stick mass. Push members or stick holders that are rigidly connected to the stick mass, but which cooperate with the threaded spindle via a ball-and-socket joint are known from the prior art.

The structure of an applicator device known from the prior art requires that the rear portion be dimensioned sufficiently long, as the threaded spindle must essentially be accommodated there with a "net length" that is sufficient to convey the entire stick mass out of the applicator device in the course of use, if possible. At the end of the rotary spindle, there must also be a fixing member which cooperates with corresponding means inside the rear portion in order to prevent the threaded spindle from rotating with the front portion. The threaded spindle must also include the intermediate member described in the foregoing and the ball-and-socket joint or some other adequate means for decoupling any rotation. The addition of these sub-members results in a substantial total length of the applicator device, as can be seen, for example, from the U.S. Pat. No. 5,366,311 A and U.S. Pat. No. 5,364,197 A patents mentioned above.

One possible object of the present invention is to provide an applicator device of the kind initially specified, in which the rear portion can be designed more freely, particularly with regard to its length, than is possible in the prior art due to the length of the threaded spindle, which must suffice to convey the entire stick mass as completely as possible out of the holding member in the course of use.

SUMMARY OF THE INVENTION

The object is achieved by providing an applicator device according to the invention.

The applicator device according to the invention is preferably provided to apply a mass, such as a cosmetic mass, in the form of a stick extending along a longitudinal axis. The applicator device has a rotatable part (as part of an advance mechanism), by which the stick mass to be applied is guided and on which there is an exit opening for the stick mass. A hollow shaft (as a further part of an advance mechanism) for axially advancing the stick mass is coupled to the rotatable part via an axially fixed rotatable connection. A body, for example in the form of a stylus or pencil, is connected to the hollow shaft. A cap for the rotatable part, as a protective part for the exposed tip of the stick mass, is detachably connectable or connected to the hollow shaft. The axially fixed rotatable connection between the rotatable part and the hollow shaft is formed by a coupling portion of the rotatable part together with a complementary counterpart coupling portion of the hollow shaft, in a region in which the hollow shaft and the rotatable part engage with each other.

In one particularly preferred embodiment, a grip member which forms the preferred grip face for handling the applicator device is formed on the hollow shaft between the rotatable part and the body. The grip member may be disposed in the form of a sleeve on the hollow shaft. For example, the grip member may be injection-moulded onto the hollow shaft during production by means of a two-component technique, or may also be pushed onto it as a separate member. The preferred region for handling, i.e. the preferred grip face of the applicator device with regard to the desired haptic and optical characteristics, can thus be designed almost at will with a free choice of materials and freely designed shape.

In one preferred embodiment, the hollow shaft is a housing for the advance mechanism. In addition to a hollow shaft and a rotatable part, the advance mechanism also includes a conveying means for the stick mass (as a further component of an advance mechanism), the conveying means being disposed axially displaceably in the hollow shaft. By suitably designing the contact surfaces of a connecting portion between the hollow shaft and the conveying means—preferably as positively engaging surfaces—, the hollow shaft and the conveying means cooperate in the connecting portion in such a way that rotation of the conveying means relative to the hollow shaft (or vice versa) causes an axial displacement of the conveying means in the hollow shaft.

At its end facing towards the exit opening on the rotatable part, the conveying means is also coupled non-rotatingly—preferably with positive engagement—via a telescopic section to the rotatable part, and such that it can be pushed axially together, in particular telescopically. This means that the conveying means can be rotated inside the hollow shaft and therefore axially moved from outside the applicator device by rotating the rotatable part. Due to the telescopic section and the connecting portion which can be designed to be relatively short, the length required for installation of the advance mechanism is significantly reduced. What is particularly advantageous in this context is that the body can be freely designed as a result, and to a considerable extent, particularly with regard to its length.

In order to convert the rotational movement into an axial translational movement, the conveying means may have a spindle portion, for example in the connecting portion, which has an outer thread which engages with an internal thread in a matching spindle portion of the hollow shaft. A rotational movement between the hollow shaft and the conveying means thus leads to an axial movement of the conveying means in the hollow shaft. The spindle portion of the conveying means can be kept short, since it moves in conjunction with the axial movement of the conveying means. The spindle portion of the hollow shaft must be designed such that its length is substantially equal to the desired conveying path.

It should be noted, with regard to the cap, that it has a push-on opening at its first end and is closed at a second end, and that it can be detachably connected to the hollow shaft in such a way that the actuating face for rotating the rotatable part is completely enclosed by the cap. The advance mechanism is thus prevented in a reliable manner from operating when the applicator device is closed. The cap protects the tip of the stick mass against contamination and damage when not in use. A plug connection between the hollow shaft and the cap is generally formed at least partially as a conical portion—not least in order to facilitate removal of the holding member from the injection moulding tool. If the stick mass contains volatile components, such as volatile silicone oils or isoparaffins, so that the stick masses remain on the skin as long as possible and in order to prevent any drift away from the place of application as long as possible, a good seal between the hollow shaft and the cap is necessary so that the clamping fit is suitably tight. A first stop face, against which a complementary cap end face in the pushed-on state abuts, can be formed on the grip member for this purpose. If the grip member consists of a soft material such as a silicone rubber or the like, it is possible, by designing the plug connection and the abutting end faces accordingly, to seal the closed applicator device better, particularly the interior of the cap.

It should be noted with regard to dimensioning the aforesaid components of the applicator device that the axial length of the telescopic section is preferably shorter than or equal to the axial length of the rotatable part. The length of the telescopic section is approximately equal, therefore, to the length of the stick that can be twisted out of the applicator device.

The sum of the axial length of the telescopic section and the axial length of the connecting portion is preferably approximately equal to the axial length of the hollow shaft. The axial length of that portion of the rotatable part which is outside the hollow shaft is preferably shorter than the minimum necessary axial length of the body. The axial length of the cap is preferably shorter than the axial length of the rotatable part, in order to prevent any canting of the cap when pulling it off the applicator device and thus to prevent any damage to the stick. The axial length of the cap is preferably smaller than or equal to the axial length of the body.

The ratio of the total length of the applicator device to the length of the cap is in a range between 2.0 and 6.0, preferably in a range between 2.5 and 5.0 and particularly preferably in a range between 3.5 and 4.5. The ratio of the length of the cap to the largest diameter of the cap is in a range between 2.5 and 5.5, preferably in a range between 3.0 and 5.0 and particularly preferably in a range between 3.5 and 4.5.

The cap and the body each have at least approximately the shape of a truncated cone, the diameter of which decreases at least section by section from the coupling portion to the respective end of the applicator device (A). The cap may have an end face at the closed end, which runs at an angle to the longitudinal axis of the applicator device that is equal to or less than 90°, and preferably less than 90°.

The hollow shaft is preferably connected fixedly to the body, preferably by bonding and/or by material connection and/or by positive engagement. At the end opposite the rotatable part, corresponding to the end of the applicator device opposite the exit opening, the body may have an integral, closed end. This is the simplest variant. Alternatively, an open end may be provided at that end of the body, and is preferably designed as a pot-like capsule. This capsule can be used to receive an additional member.

An additional element may be a fixedly inserted end plug, for example. This end plug can be adapted to display the colour of the stick mass. For example, the end plug can be coloured according to the colour of the stick mass, so that the colour of the stick contained in the closed applicator device can be seen from the outside. Such an end plug is preferably connected non-detachably, i.e. fixedly, to the body. As another alternative, a fixedly inserted applicator, for example a blending applicator for blending applied stick mass, may be provided. Finally, a removable applicator, in particular one with a sharpener for the stick, or the like, can also be removably inserted into the end of the body. The end of the applicator device with an inserted applicator, as described above, thus serves to blend the stick mass, for example. When the applicator is removed, a sharpener provided on the applicator for the stick can be used. Of course, in the variants with an applicator, the entire applicator or a part thereof can also be coloured to display the colour of the stick mass.

BRIEF DESCRIPTION OF THE DRAWINGS

Other advantageous configurations of the invention, and one embodiment thereof, shall now be described with reference to the attached drawings. The terms "top", "bottom", "left" and "right" used when describing the embodiment relate to the drawings oriented in such a way that the reference signs and names of the figures can be read normally. In the drawings.

DETAILED DESCRIPTION

Figure 1:
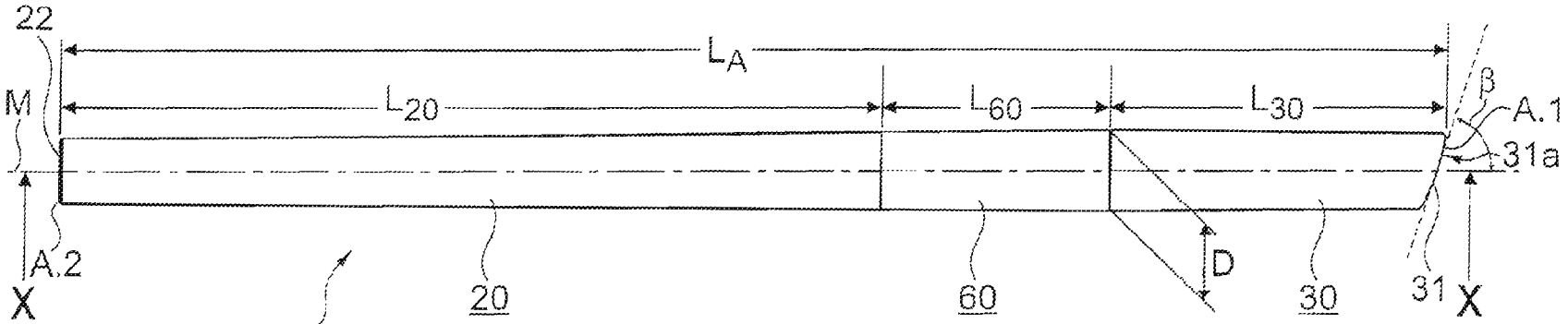
FIG. 1 shows a side view of an applicator device according to the invention.

FIG. 1 shows a side view of an applicator device A with a longitudinal axis M according to the invention, in the closed state, i.e. with a cap 30 fitted thereto. The applicator device has an axial length $L_A$, which extends in the direction of longitudinal axis M from a first end with cap 30, i.e. from a cap end A.1 of applicator device A, to a second end, a body end A.2, formed by a body 20 in the form of a stylus or pencil.

Between cap 30 having an axial length $L_{30}$ and body 20 having an axial length $L_{20}$, a grip member 60 having an axial length $L_{50}$ is provided as a preferred grip surface or holding surface for handling applicator device A. Body 20 extends from grip member 60 to the body end A.2 of applicator device A and lengthens applicator device A like the barrel of a writing utensil.

Together, body 20 and grip member 60 basically have the shape of a truncated cone, the largest diameter D of the truncated cone being adjacent to cap 30 and tapering towards body end A.2. In this embodiment, the change in diameter is continuous, but it may also be discontinuous, for example in steps. Cap 30 is also frusto-conical in shape, the largest diameter D of cap 30 being adjacent to grip face 60, and the diameter of cap 30 likewise decreasing towards cap end A.1. Applicator device A thus has a lateral contour in the shape of two truncated cones joined with their respective base surfaces to each other.

Alternatively, the largest diameter of cap 30 may also be provided at the cap end A.1. If the diameter of cap 30 then has the same diameter at the open end (see FIG. 3) as the adjacent grip member 60, applicator device A has the overall shape of a truncated cone when in the closed state.

At the closed cap end 31, cap 30 in FIG. 1 has a cap end face 31*a* which runs at an angle □ to longitudinal axis M of applicator device A that is equal to or less than 90°, and preferably less than 90°. When angle □ is 90°, the end face runs substantially perpendicular to the longitudinal axis M of applicator device A.

Figure 2:
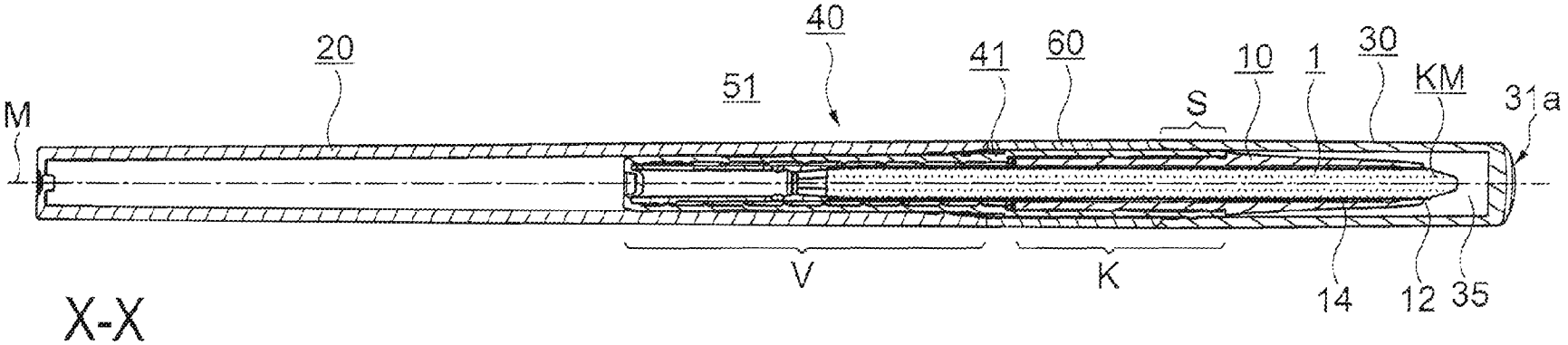
FIG. 2 shows a cross-sectional view of the application device along the line X-X in FIG. 1.

FIG. 2 shows a cross-sectional view along the line X-X of the applicator device A shown in FIG. 1. In addition to the components already described in connection with FIG. 1, the cross-sectional view in FIG. 2 along the line X-X also shows functional elements of applicator device A that are located inside applicator device A or which are inside cap interior 34 when cap 30 has been pushed on.

Applicator device A has a rotatable part 10 (as a component of advance mechanism 40), through which a stick mass KM, in the form of a stick 1, is guided for application. Stick mass KM may be a cosmetic (stick) mass made of a thixotropic preparation which is to be deformed or liquefied when exposed to compressive or shear forces—an effect that is to be prevented as far as possible when stick mass KM moves axially inside applicator device A.

Rotatable part 10 is essentially a tubular body with an exit opening 12 for stick mass KM. Rotatable part 10 is coupled by means of an axially fixed rotatable connection to a hollow shaft 41, a further component of advance mechanism 40, for axially advancing stick mass KM. The axially fixed rotatable connection is formed by a coupling portion K between rotatable part 10 and hollow shaft 41, in that hollow shaft 41 and rotatable part 10 are engaged with or are inserted into each other in coupling portion K. Rotatable part 10 can thus be rotated in hollow shaft 41 about the longitudinal axis M of applicator device A, yet is fixed in its axial arrangement relative to hollow shaft 41 by first and second axial holding members 16 and 46 acting in the axial direction (see FIGS. 4*a*, 4*c*), which are disposed complementarily to each other on opposite surfaces of rotatable part 10 and hollow shaft 41.

In FIG. 2, hollow shaft 41 is fixedly connected via a connection portion V to body 20.

As a protective part for stick mass KM projecting from exit opening 12, cap 30 encapsulates actuating face 15 for rotating rotatable part 10 and is connected by means of a plug connection S adjacent to grip member 60 to hollow shaft 41 in a detachable manner—for example with a clamping fit from which it can be pulled off, or by being unscrewed. This means that rotatable part 10 cannot be accessed from outside applicator device A and cannot be rotated when cap 30 has been pushed on, so advance mechanism 40 cannot be actuated. The function of advance mechanism 40 is described in detail further below with reference to FIGS. 4*a* to 4*c*.

Figure 3:
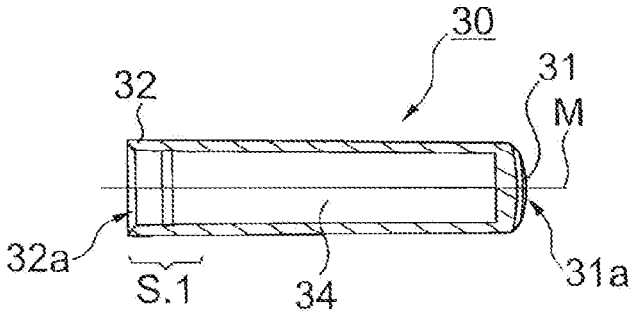
FIG. 3 shows a cross-sectional view of the cap of the applicator device shown in FIG. 2.

FIG. 3 shows a cross-sectional view of cap 30 of applicator device A in FIG. 2, with its closed cap end 31 with cap end face 31*a* and an open cap end 32 with an annular cap end face 32*a*. On the inside, cap 30 has an inner space 34 for receiving rotatable part 10. In the vicinity of the open cap end 32, a cap plug portion S.1 for detachably connecting cap 30 to a corresponding plug portion S.2 of hollow shaft 41 is located in inner space 34.

In the following, the method of operation of the advance mechanism of the applicator device A in FIG. 2 will be explained in further detail with reference to FIGS. 4*a* to 4*c*. For better understanding, the three main components of the advance mechanism are shown separately from each other—their intended interaction is shown in FIG. 2, so the four Figures must always be considered in combination in the following description.

Figure 4A:
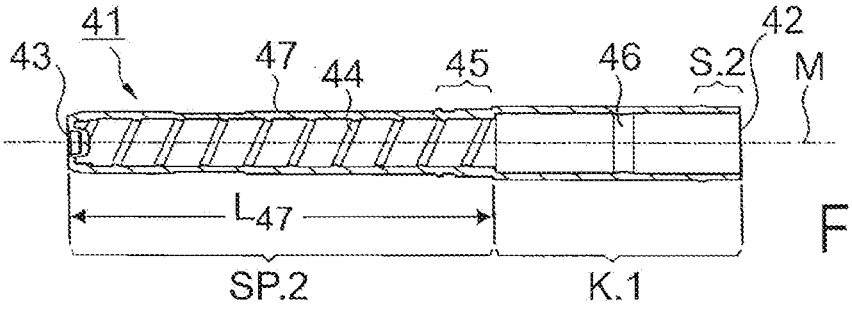
FIG. 4*a* shows a cross-sectional view of the hollow shaft of the advance mechanism of the applicator device shown in FIG. 2.

FIG. 4*a* shows the housing of advance mechanism 40, which essentially consists of a hollow shaft 41 with an open shaft end 42 in the direction of the rotatable part 10 and a closed shaft end 43 in the direction of body 20. A conveying means 51 (as a further component of advance mechanism 40) for moving and holding stick mass KM is disposed axially displaceably in hollow shaft 41; conveying means 51 and stick mass KM are shown separately in FIG. 4*b*.

Figure 4B:
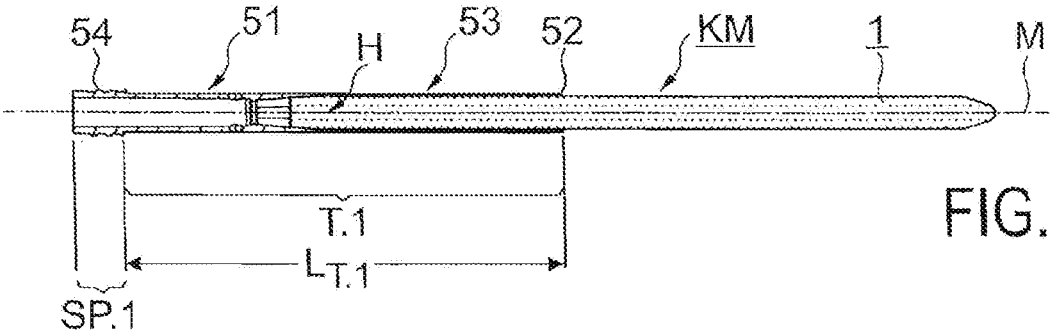
FIG. 4*b* shows a cross-sectional view of the stick with conveying means of the advance mechanism of the applicator device shown in FIG. 2.

FIG. 4*b* shows conveying means 51, which is guided as a pusher member similar to a piston inside hollow shaft 41. Stick mass KM is located in a holding member H inside conveying means 51 and as a result is connected in a sufficiently stable manner to conveying means 51. When conveying means 51 makes an axial movement in the direction of exit opening 12, stick mass KM is pressed out of applicator device A, and when conveying means 51 makes an axial movement in the opposite direction away from exit opening 12, stick mass KM is pulled into the applicator device.

In order to permit the necessary axial movement of conveying means 51, hollow shaft 41 and conveying means 51 are in contact through positive engagement via first spindle portion SP.1 of conveying means 51 and a second spindle portion SP.2 of hollow shaft 41. Spindle portion SP.1 and SP.2 have matching threads for this purpose, namely an outer thread 54 in spindle portion SP.1 of conveying means 51 and an internal thread 44 in spindle portion SP.2 of hollow shaft 41. Rotating conveying means 51 relative to hollow shaft 41 can thus be converted into axial displacement of conveying means 51 along the longitudinal axis M in hollow shaft 41.

Conveying means 51 is non-rotatingly coupled, beginning with its open conveying means end facing in the direction of exit opening 12, via a first telescopic section T.1 to a second telescopic section T.2 in the interior 17 of the rotatable part, but can be pushed axially and telescopically together. This non-rotating coupling is ensured by contact surface 53 of conveying means 51 in telescopic section T.1 mating by positive engagement with the inner surface 13 of the rotatable part in the second telescopic section T.2. The respective contact surfaces 53 and 13 of telescopic sections T.1 and T.2 are designed with complementary cross-sections, for example as regular polygons or the like.

Figure 4C:
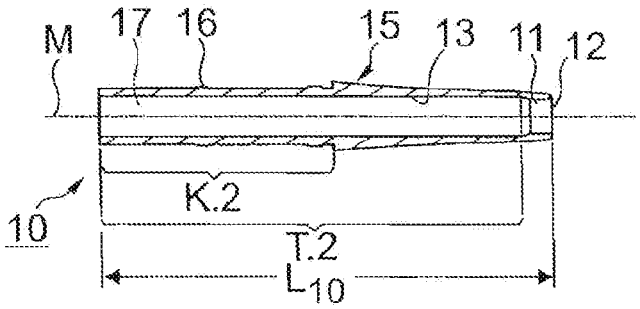
FIG. 4*c* shows a cross-sectional view of the rotatable part of the applicator device shown in FIG. 2.

FIG. 4*c* shows a cross-sectional view of the rotatable part 10 of the applicator device in FIG. 2. Rotatable part 10 is substantially tubular, so that the stick mass KM is guided through rotatable part 10 and can pushed out at exit opening 12 of rotatable part 10. Rotatable part 10 is in contact with the stick mass KM only in a relatively small support section 11, in a region that adjoins exit opening 12 on the inside, in order to support the tip of the stick mass KM during use. In the remaining region of rotatable part 10 towards hollow shaft 41, there is an annular gap 14 (shown in FIG. 2) between the inner surface of the rotatable part 13 and the stick mass KM.

Annular gap 14 allows telescopic section T.1 of conveying means 51 to be guided between stick mass KM and the inner surface of the rotatable part 13 when it moves axially in the direction of exit opening 12. Annular gap 14 also ensures that no contact occurs inside rotatable part 10 with the stick mass KM, except in support section 11.

The portion of rotatable part 10 that is visible outside applicator device A to a user is an actuating face 15 for rotating rotatable part 10. In order to actuate or drive advance mechanism 40, a user grips the applicator device at grip member 60 (see FIGS. 1 and 2) with his or her right hand, for example, and then turns rotatable part 10 at actuating face 15 with the thumb and index finder of his or her left hand. Rotatable part 10 is rotatably but axially fixedly mounted on an inner coupling portion K.1 of hollow shaft 41 to a coupling portion of rotatable part K.2 of rotatable part 10 in coupling portion K (see FIG. 2). Rotatable part 10 can thus be rotated relative to the rest of the applicator device, in particular the hollow shaft 41. This rotational movement is transferred by the positive engagement of telescopic sections T.1 and T.2 from rotatable part 10 to conveying means 51 of advance mechanism 40, thus driving the latter.

Figure 5:
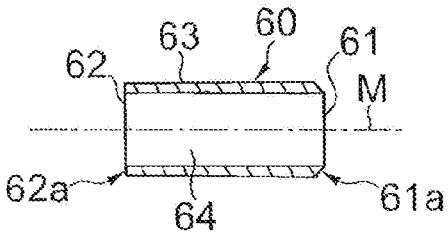
FIG. 5 shows a cross-sectional view of the grip member of the applicator device shown in FIG. 2.

FIG. 5 shows a cross-sectional view of the grip member shown in FIG. 2. Grip member 60 is a tubular sleeve with a first grip member cap end 61 oriented towards cap 30 and having a first annular grip member end face 61*a*, and a second grip member body end 62 oriented towards body 20 and having a second annular grip member end face 62*a*. End face 61*a* is bevelled in complementary manner to end face 32*a* of cap 30 (see FIG. 3*a*), or has a matching phase. If cap 30 is pushed on (see FIG. 2), then the corresponding end faces 61*a* and 32*a* of grip member 60 and cap 30, respectively, lie one on top of the other.

If a soft plastic, for example a silicone rubber or the like, is used as material for grip member 60, then the end faces 61*a* and 32*a* in contact with each other can also serve as a sealing face for sealing the inner space 34 of cap 30 and preventing the stick mass KM from drying out. The annular end face 62*a* on the left is designed to complement an end face 21*a* on the adjoining body 20; a sealing function is not necessary here, however. Grip face 63 of grip member 60 preferably transitions without a gap to body 20 (see FIG. 2). When the applicator device is in the complete assembled state, the hollow shaft 41, in particular the coupling portion K between hollow shaft 41 and rotatable part 10, is in the interior of grip member 64 of the sleeve-shaped grip member 60.

Grip member 60 can be produced separately as a sleeve from a haptically and visually suitable material, for example silicone rubber or similar, and can be pushed onto hollow shaft 41 when putting together the applicator device. In order that grip member 60 is permanently axially fixed to hollow shaft 41, additional holding structures may be provided on the contact surface(s) of grip member 60 and/or hollow shaft 41. An appropriate combination of materials and dimensioning of the inner diameter of grip member 60 already ensures that there is sufficient static friction between grip member 60 and hollow shaft 41. Alternatively, grip member 60 can be injection-moulded directly onto hollow shaft 41, for example by means of a two-component injection-moulding technique during production of the applicator device.

Figure 6A:
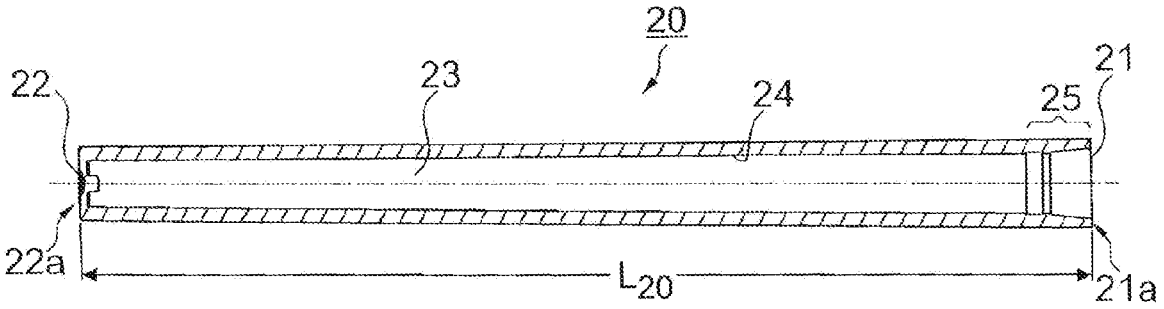
FIG. 6*a* shows a cross-sectional view of the body of the applicator device shown in FIG. 2.

FIG. 6*a* shows a cross-sectional view of the body shown in FIG. 2. In the embodiment shown, body 20 extends along longitudinal axis M from a first grip member body end 21 oriented towards the grip member and having a first annular body end face 21*a* to a second body end 22 having a body end face 22*a* that forms the second end A.2 of the applicator device A in FIGS. 1 and 2.

Body 20 is preferably hollow in design in order to receive the connecting portion 47 of hollow shaft 41 in an inner body space 23. In order to connect the body 20 undetachably to hollow shaft 41 as far as possible, a latch portion 25 is provided on the inner body surface 24 in the body interior 23 adjacent to the grip member body end 21, wherein said latch portion is able to engage with a corresponding engaging portion 45 on hollow shaft 41 (see FIG. 4*a*). Latch portion 25 and engaging portion 45 are designed in such a way that the body 20 can only be detached from hollow shaft 41 by destruction or by exerting enormous force.

Alternatively or additionally, body 20 and hollow shaft 41 can be connected undetachably to each other by material connection—for example by means of ultrasonic welding—or by means of an adhesive bonding technique.

Figure 6B:
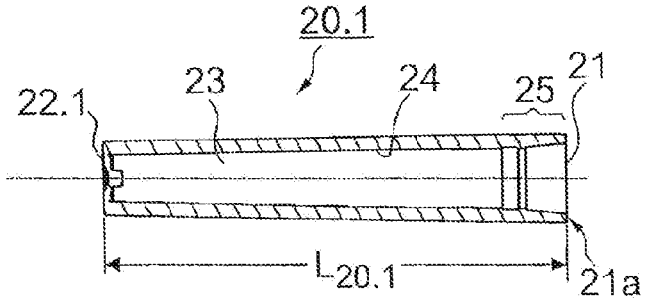
FIG. 6*b* shows a cross-sectional view of an alternative embodiment of the body.

FIG. 6*b* shows a cross-sectional view of an alternative embodiment of a body 20.1. The difference from body 20 in the embodiment described with reference to FIGS. 1 to 5 is that the axial length $L_{20.1}$ of body 20.1 is significantly shorter than body 20. This is an important advantage of the structure of the applicator device being described here, namely the significantly greater freedom in designing the body, in particular its length. The body end 22.1 of body 20.1 is significantly closer to the grip member than in the embodiment described in the foregoing.

Body 20.1 is essentially dimensioned in such a way that the connecting portion 47 of hollow shaft 41 fits into body 20.1. Axial length $L_{20.1}$ is approximately equal to or slightly longer than the axial length L47 of the connecting portion 47 of hollow shaft 41.

As a result, one obtains with body 20.1 a very short applicator device, yet ease of handling is still provided, for example when putting on make-up. Applicator devices with body 20.1 are particularly suitable for small make-up sets that can be carried along with other applicator devices and therefore take up less valuable space, for example in a handbag, due to the reduced amount of space required.

Figure 6C:
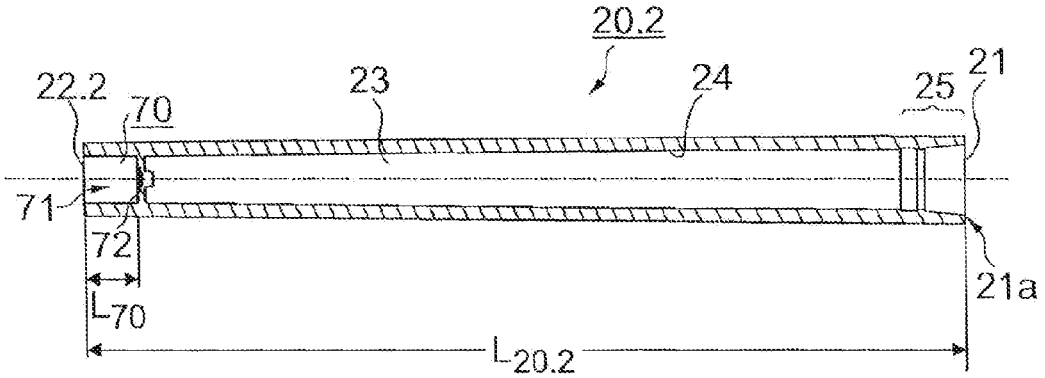
FIG. 6*c* shows a cross-sectional view of another alternative embodiment of the body.

FIG. 6*c* shows a cross-sectional view of another alternative embodiment of a body 20.2. At end 22.2 of body 20.2, a capsule 70 with a pot-like receiving compartment 71 is integrated. Capsule 70 has a depth $L_{70}$ from end 22.1 and ends at a capsule base 72.

Instead of an integral, closed end 22 or 22.1 at its end opposite the rotatable part (not shown), body 20.2 thus has an open end 22.2 with capsule 70 for receiving an additional member.

The additional member may be a fixedly inserted end plug which is produced separately from body 20.2 and which can be used to display the colour of the stick mass KM. To serve that purpose, the end plug is given a colour which is the same as or assigned to that of stick mass KM of the applicator device. The colour of the stick mass can thus be induced without pulling off the cap from the outside. This also has an advantage over caps marked in the same way, which can be swapped between applicator devices of the same construction.

Alternatively, the end plug can be an applicator to be fixedly inserted into capsule 70, or also a removable applicator. The applicator may be a blending applicator, for example, with which applied stick mass can be blended. If a removable applicator is provided, then another functional member can be provided at the end of the applicator opposite the actual applicator member. A sharpener for stick mass KM may be provided, for example, as one such additional functional member. A cap for protecting the applicator may also be provided. In order to sharpen the stick mass, the applicator with the pushed-on cap as grip can be pulled off and the stick mass sharpened with the exposed sharpener. If only the cap is removed, the body of the applicator device can then be used as a stylus for handling the applicator.

Capsule 70 described in conjunction with body 20.2 can also be provided, of course, on a body 20.1 in FIG. 6*b*.

The invention claimed is:

1. An applicator device for applying a mass in the form of a stick extending longitudinally along a longitudinal axis, comprising a rotatable part through which the stick is guided and which has an exit opening for the stick, a hollow shaft coupled to the rotatable part via an axially fixed rotatable connection for axially advancing the stick, a body fixedly connected to the hollow shaft, and a cap for the rotatable part, which is detachably connected to the hollow shaft, wherein the axially fixed rotatable connection is formed by a coupling portion of the rotatable part and a complementary counterpart coupling portion of the hollow shaft in a coupling portion in which the hollow shaft and the rotatable part engage with each other, and the hollow shaft has a grip member disposed between the rotatable part and the body in the region of the coupling portion, wherein the grip member in the form of a sleeve is disposed around the hollow shaft.

2. The applicator device according to claim 1, wherein the hollow shaft is fixedly connected to the body by bonding and/or by material connection and/or by positive engagement.

3. The applicator device according to claim 1, wherein a conveying means for the stick is disposed axially displaceably in the hollow shaft, the hollow shaft and the conveying means cooperate, by positive engagement, with respective connecting portions in such a way that rotation of the conveying means relative to the hollow shaft causes an axial displacement of the conveying means in the hollow shaft.

4. The applicator device according to claim 3, wherein the conveying means is configured in its connecting portion as a threaded spindle with an outer thread which engages with an internal thread in the connecting portion of the hollow shaft.

5. The applicator device according to claim 3, wherein the conveying means is non-rotatingly coupled at its open conveying means end facing the exit opening via a first telescopic section to a second telescopic section of the rotatable part such that it can be pushed axially together telescopically.

6. The applicator device according to claim 5, wherein the axial length of the telescopic section of the conveying means is shorter than or equal to the axial length of the rotatable part and/or that the sum of the axial length of the telescopic section of the conveying means, the axial length of the coupling portion and the axial length of the connecting portion of the conveying means is approximately equal to the axial length of the hollow shaft.

7. The applicator device according to claim 1, wherein the cap has a push-on opening at one end and is closed at the other end, and can be detachably connected to the hollow shaft in such a way that an actuating face is completely enclosed by the cap, and/or the cap has an end face at the closed end, which runs at an angle to the longitudinal axis of the applicator device which is less than 90°.

8. The applicator device according to claim 1, wherein the axial length of the portion of the rotatable part which is outside the hollow shaft is shorter than the axial length of the body, and/or in that the axial length of the cap is shorter than the axial length of the rotatable part, and/or in that the axial length of the cap is shorter than or equal to the axial length of the body.

9. The applicator device according to claim 1, wherein the ratio of the total length of the applicator device to the length of the cap is in a range between 2.0 and 6.0, and/or the ratio of the length of the cap to the largest diameter of the cap is in a range between 2.5 and 5.5.

10. The applicator device according to claim 1, wherein the cap and the body each have at least approximately the shape of a truncated cone, the diameter of which decreases at least section by section from the coupling portion to the respective end of the applicator device.

11. The applicator device according to claim 1, wherein a first stop face is formed on the grip member, against which an end face of the cap in the pushed-on state abuts to seal the inner space of the cap.

12. The applicator device according to claim 1, wherein the body has a closed end integral with the body at the end opposite the rotatable part.

13. The applicator device according to claim 1, wherein the body has an open end at the end opposite the rotatable part, on which a capsule for receiving an additional member is formed, wherein the additional member is a fixedly inserted end plug which is preferably adapted to display the colour of the stick mass, and which is coloured according to the colour of the stick mass, or is a fixedly inserted applicator or a removable applicator with a sharpener for the stick.

* * * * *